US007191483B2

(12) United States Patent
Hochschild

(10) Patent No.: US 7,191,483 B2
(45) Date of Patent: Mar. 20, 2007

(54) COMPOSITE FOAM MATTRESS ASSEMBLY

(75) Inventor: Arthur A. Hochschild, Garden Grove, CA (US)

(73) Assignee: American Pacific Plastic Fabricators, Garden Grove, CA (US)

( * ) Notice: Subject to any disclaimer, the term of this patent is extended or adjusted under 35 U.S.C. 154(b) by 0 days.

(21) Appl. No.: 11/145,374

(22) Filed: Jun. 3, 2005

(65) Prior Publication Data

US 2006/0272098 A1 Dec. 7, 2006

(51) Int. Cl.
*A47C 27/15* (2006.01)

(52) U.S. Cl. ..... 5/740; 5/691; 5/727; 5/722

(58) Field of Classification Search ..... 5/691, 5/903, 722, 727, 738, 740
See application file for complete search history.

(56) References Cited

U.S. PATENT DOCUMENTS 2,651,788 A * 9/1953 Forwood ..... 5/716
3,521,311 A 7/1970 Cohen
3,534,417 A 10/1970 Boyles
3,846,857 A 11/1974 Weinstock
3,939,508 A 2/1976 Hall et al.
4,809,375 A * 3/1989 Bull ..... 5/722
4,955,095 A * 9/1990 Gerrick ..... 5/691
5,488,746 A * 2/1996 Hudson ..... 5/500
5,513,402 A 5/1996 Schwartz
5,644,811 A * 7/1997 Cavazos ..... 5/738
5,953,779 A 9/1999 Schwartz
6,101,653 A * 8/2000 England ..... 5/738
6,223,371 B1 5/2001 Antinori et al.
6,256,821 B1 7/2001 Boyd
6,269,504 B1 8/2001 Romano et al.
6,578,220 B1 6/2003 Smith
6,601,253 B1 8/2003 Tarquinio

* cited by examiner

*Primary Examiner*—Michael Trettel
(74) *Attorney, Agent, or Firm*—Squire, Sanders & Dempsey L.L.P.

(57) ABSTRACT

A method of building and marketing composite foam mattress assemblies and a resulting bed in which the properties of the mattress may be modified in the sectors of the mattress and in the zones of the mattress.

13 Claims, 3 Drawing Sheets

COMPOSITE FOAM MATTRESS ASSEMBLY

RELATED APPLICATION

The present application is related to a utility application Ser. No. 11/504,752 filed Aug. 14, 2006, entitled Composite Mattress Assembly and Method for Adjusting the Same of the same inventor. The related application is a continuation-in-part of the present application.

BACKGROUND OF THE INVENTION

Standard mattress designs have evolved very little in the past fifty years. A standard mattress generally includes a set of metal springs or coils mounted either on a base under a pad, or sandwiched in the center of a pair of pads. The metal springs and pad or pads are then covered with a strapping material. The entire structure is then sewn into a cloth cover and the edges are wrapped and sewn. Thus, once the mattress is fabricated, the components are not replaceable. The limitations of metal spring mattresses combined with improved quality and durability of foam products has lead to the relatively recent development of a foam core mattress as a viable alternative to metal spring mattress. A foam core mattress can provide significant improvements in comfort and support compared to conventional spring-based mattresses. For example, spring-based mattresses inherently have varying properties over their surface, and the variations of properties relating to zone and surface areas are improved only with great difficulty.

A basic foam mattress may include one or more layers of foam having desirable properties assembled into a fabric cover so as to appear identical in appearance to a standard metal spring mattress. A foam mattress may include a center core of relatively high resilience foam sandwiched between two layers of lower resilience foam encased in a fabric shell. This construction allows for a reversible mattress.

The reaction of a user to a mattress is highly personal, and the prospective purchaser in the showroom is likely to decide to purchase or not to purchase a product within a few minutes. The most prevalent explanation for the return of the mattress relates to an aspect of the comfort of the user or users specifically the perceived temperature and firmness of the mattress. It is commonly observed that most people spend 6 to 8 hours each day in bed. Accordingly, in marketing mattresses to consumers, the retail stores typically stress the quality and the comfort of the mattress, to justify sales price of a high quality mattress. Many retailers who offer high end mattress products also offer a guarantee allowing the purchaser to return the mattress if they are not completely satisfied within a certain time period. As a result, it is not uncommon for retail stores to have return rates of eight to ten percent. These levels of return are significant and indeed compounded by the stigma attached to a "used" mattress that may only be resold at best at about ten percent of its original sales price.

INVENTION SUMMARY

It is an object of this invention to provide a method of building and marketing composite foam mattress assemblies and a resulting bed in which the properties of the mattress may be modified in the sectors of the mattress and in the zones of the mattress. For example, a different firmness or response for the left sector and the right sector may be desirable. Also, different firmnesses to support the zones for the head, the torso, and the legs may be desirable to custom fit a mattress for one or two users.

This invention offers to the merchant and to the user a wide range of demonstrable and selectable responses. As a result customers can customize their mattress, providing the retailer with a much greater opportunity to make the sale of an expensive product that depreciates instantly upon sales. Furthermore, in the event of dissatisfaction, the local properties of the mattress can later be modified by replacement of localized parts rather than having the purchaser return a mattress.

Accordingly, the present invention provides an improvement over the standard foam mattress, providing an alterable and reconfigurable composite mattress as described herein having a plurality of vertical zones, each formed beneath a respective horizontal sector, there being a plurality of horizontal sectors whereby the load-responsive properties of the sectors can be selected and provided in such a way as to be locally responsive and supportive. The construction is enclosed in a multi-piece fabric encasement having a removable cover allowing user access to the foam components.

The above and other features of this design will be fully understood from the following detailed description and the accompanying drawings, in which:

DETAILED DESCRIPTION OF THE PREFERRED EMBODIMENTS

Figure 1:
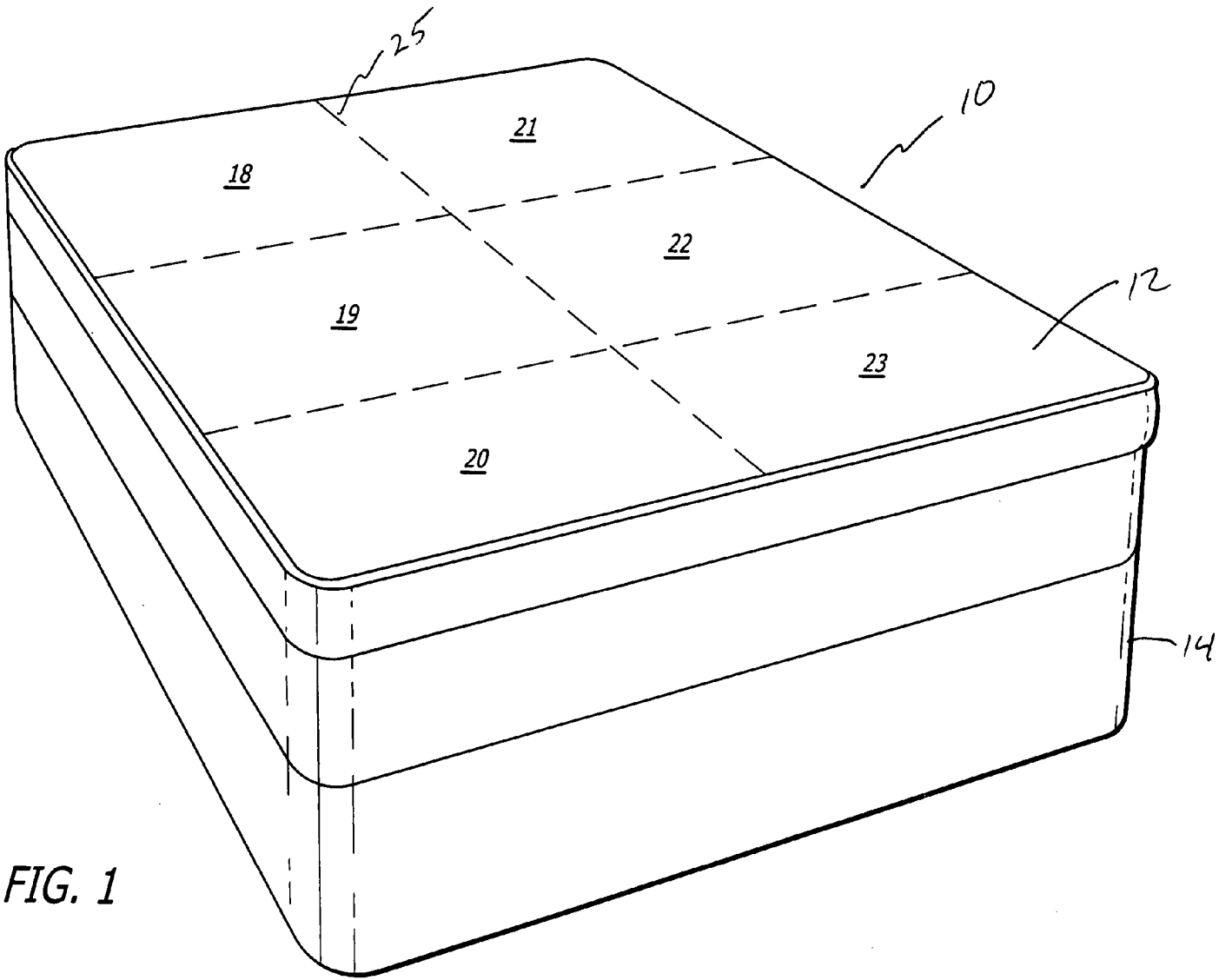
FIG. 1 is a perspective view of a mattress assembly.
Figure 2:
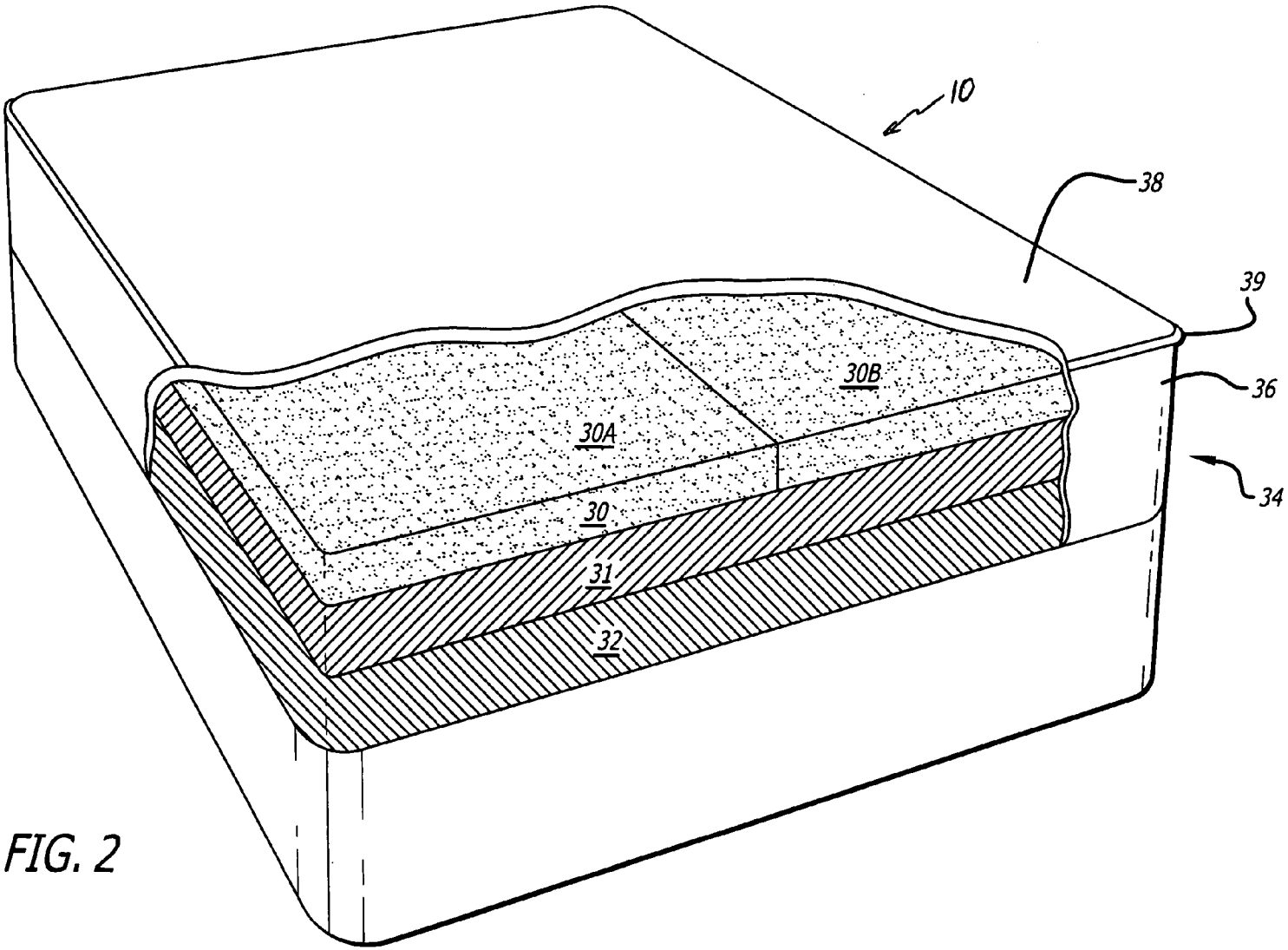
FIG. 2 is a perspective, partially cut-away view of the mattress assembly.
Figure 3:
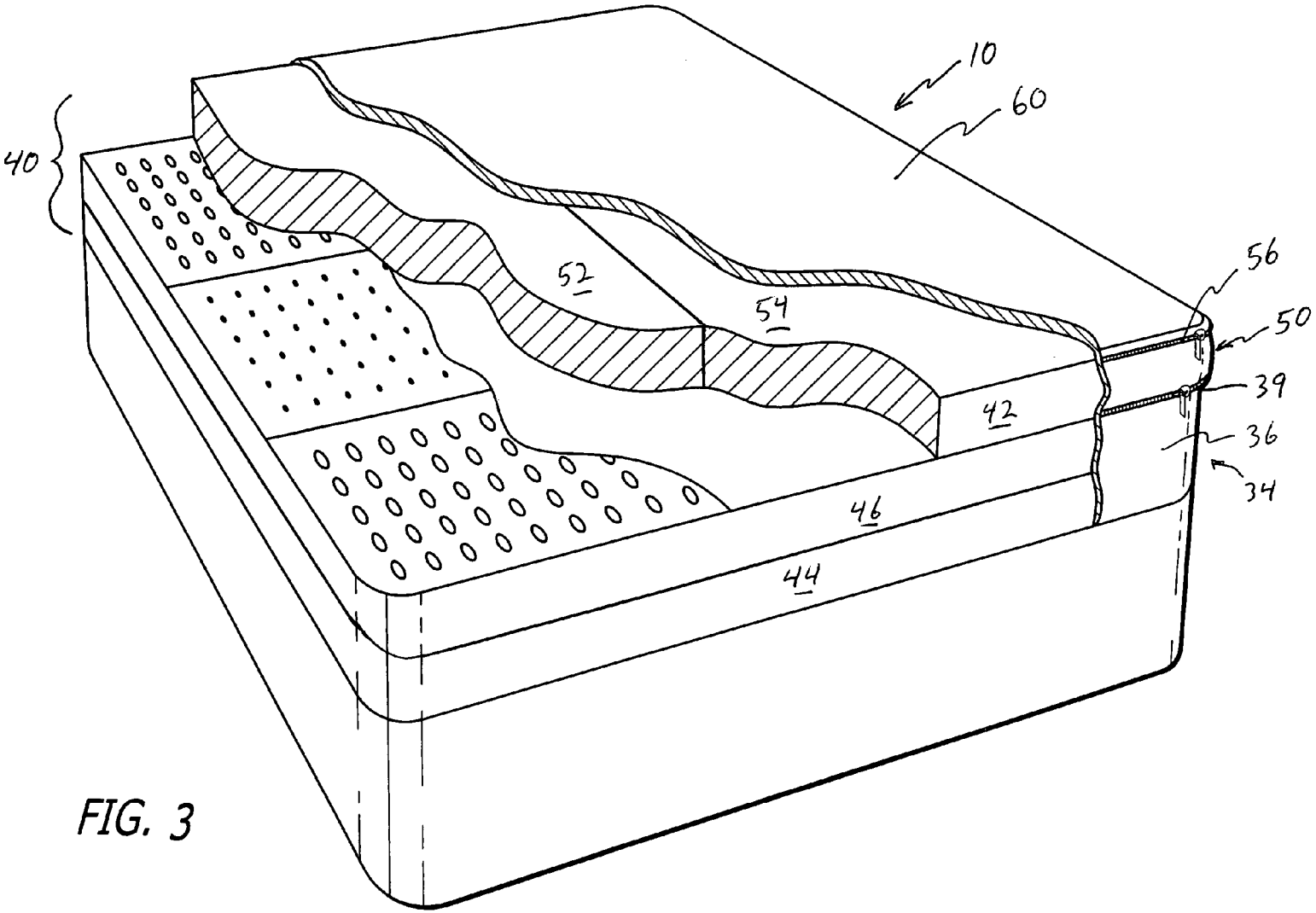
FIG. 3 is a perspective, partially cut-away view of an alternative configuration of a mattress assembly.

Mattress assemblies 10 according to aspects of the present design are shown in FIGS. 1–3. FIG. 1 shows a perspective looking down toward the upper surface 12 of a mattress assembly 10. It is shown as a mattress assembly 10 suitable for use by two persons. The mattress assembly 10 is shown on top of a box foundation 14.

For reference herein, the mattress assembly 10 has a first longitudinal phantom line 25 dividing the mattress into a left sector and a right sector. Further, horizontal phantom lines show the division of the mattress sectors into zones 18, 19, 20 and 21, 22, 23. Zones 18 and 21 will be located beneath the head and shoulders of a user; zones 19 and 22 beneath the torso; and zones 20 and 23 beneath the legs and feet. These regions of the mattress assembly 10 are intended to be configurable and thereby responsive to each of those respective parts of the body of the user(s).

FIG. 2 shows a perspective, partially cut-away view of the mattress assembly 10 having an internal construction that may be made up of a top layer 30, middle layer 31, and bottom layer 32. These layers may each be provided with physical properties selectable to provide appropriate and desired support to the portion of the body which rests atop each zone. In some of these layers, the adjacent regions or zones may be identical, and in others the properties may vary.

The mattress of FIG. 2 may be configured from blocks of foam material. Ultimately they may merely be stacked, or after approval of function, they may be cemented or taped together. Also, some blocks in a given layer may be provided as a continuous body having uniform properties or a continuous body with different local properties from sector to sector and zone to zone.

Most frequently, a king or queen size mattress will have a top layer 30 divided longitudinally in two parts 30A and 30B as shown in FIG. 2 so as to allow respective left and right sides of the mattress assembly to be selectively interchangeable with foam blocks having specific characteristics selected to be more comfortable to persons resting on a respective side. Alternatively, the layers may be formed as a continuous body that may include local modifications, for example channels formed in the foam block that may be spaced in a manner to impact the resilience of the foam block.

The foam blocks making up the top layer 30, middle layer 31 and bottom layer 32 are assembled into a multi-component mattress casing 34 made of fabric and having an underside (not shown) and sidewall 36 six to twelve inches high defining a cavity for the foam blocks.

A removable and interchangeable mattress cover 38 extends over the top layer 30 and is secured at its peripheral edge to the upper edge of the sidewall 36 by a zipper 39. Preferably, the zipper 39 has equal number of teeth on the mattress cover 38 and on the sidewall 36.

FIG. 3 depicts an alternative embodiment of the mattress assembly 10. In FIG. 3, the mattress assembly 10 is also shown in a partially cut-away view. The mattress assembly 10 in this embodiment includes a three zone latex foam core 40. A first zone 42 and a third zone 44 preferably have a similar resilience while a second zone 46 in the center portion of the bed extending across a double, queen size or king size bed has a more dense urethane latex foam core. Each of the foam blocks 42 may have a plurality of spaced apart openings 48 as shown in the blocks of the second zone 46 which provide air pockets increasing the cushioning effect of the foam core. The second and third zones 46 and 44 are enclosed within a fabric mattress casing 34 including an underside (not shown) and sidewalls 36 six to twelve inches high. The fabric cover has a zipper 39 at the upper periphery of the sidewalls 36. Removal of the foam cores and reconfiguration of the mattress assembly 10 may be accommodated by opening the zipper and removing one or more of the foam cores for replacement with a foam core having a different configuration.

The on top of the mattress casing 34 of the mattress assembly 10 is an overlay cover 50. The overlay cover 50 includes a bottom sheet 56, sidewall 58 and top 60. The overlay cover 50 includes one or more foam elements 52 and 54 forming the first zone 42 and constrained within the cavity defined by the bottom sheet 56 and sidewall 58. Preferably the overlay cover is one to three inches in thickness.

The foam elements 52, 54 may be either latex foam block or blocks or plush memory or viscoelastic foam block or blocks depending on the preference of the user. The overlay cover 50 may be replaceable so that if a user selects a latex foam block and decides at a subsequent time that they would prefer the viscoelastic foam block then the overlay may be opened and the foam block can be replaced. The foam overlay includes a zipper 56 which allows for removal of the foam elements 52, 54 from the overlay cover 50. In addition, on the bottom periphery of the overlay cover is a zipper component which allows connection to the zipper located on the upper portion of the mattress casing 34. The zipper on the top of the overlay allows for a selection of alternate materials for the top 60 of the overlay cover. The top 60 of the overlay cover may be formed from a stretch cover material, a quilted stretch with cashmere cover material or a pillow top cover. The selection of the respective top 60 or cover to go over the foam elements 52, 54 allows for a greater flexibility in design and selection of mattress qualities to enhance the salability of the mattress assembly.

The interchangeability of the components of the mattress assembly, including the removable and replaceable top of the overlay cover, its replaceable top, the replaceable foam cores in the overlay cover, and the replaceable or switchable foam core elements contained in the mattress casing 34 provides for a unique ability to reconfigure the mattress to a user or even different users in locations such as within a hotel, without having to move and replace an entire mattress. In addition, for users that purchase a mattress and then decide that they would like a different feel to the mattress, the ability to have removable elements so that one element can be removed and replaced and thereby give the user a different feel for the mattress substantially increases the perceived value of the mattress to the consumer.

There is also a significant advantage to the retailer of the mattress as the retailer will reduce or minimize the number of returns of mattresses from customers who are dissatisfied because of the feel of the mattress. Instead, the retailer can determine with the user what portion of the mattress assembly is unsatisfactory and replace only that portion of the mattress assembly so as to provide a complete unit that has acceptable performance for the consumer. The result of this interchangeability is to substantially reduce the number of returns of mattresses after purchase by a consumer.

This is particularly beneficial in that a return mattress cannot be resold once it has been used. Thus, a dissatisfied customer who returns a standard type of a mattress which does not offer the replacement or repair capabilities is a substantial cost overhead to the mattress retailer. The ability to replace only a component of the system so as to provide the customer with the preferred mattress characteristics is therefore a substantial advantage both to the retail facility and to the marketing and distribution of the mattress assembly of the present invention.

As may be appreciated by those skilled in the art, having a removable mattress cover which may be replaced by alternative mattress covers which are matched so as to have the same zipper teeth count allows mattress covers to be removed and washed or removed and replaced. Thus, if the mattress cover is not providing the desired comfort level, then the mattress cover or top such as a pillow top cover can replace a stretch cover so as to allow additional padding and spacing as between the user and the foam core of the overlay. If the mattress is too springy, then the latex foam core and the overlay may be replaced with the viscoelastic plush memory foam blocks in the overlay cover to make the matters less springy and softer.

The overlay cover 50 shown in FIG. 3 can also be utilized in the mattress assembly 10 of FIG. 2 by removing the cover 38 on the assembly of FIG. 2 and replacing it with the foam overlay cover of FIG. 3. This configuration puts the foam overlay atop the three layer foam core construction of the configuration of FIG. 2.

For those in the industry, the ability to reconfigure the mattresses quickly and thereby custom tailor the mattress to a particular user, or to replace certain components for the user so as to prevent, minimize or eliminate returns by unsatisfied customers is a substantial advantage over the construction of mattresses which have the components completely encased within a fabric cover. A modular system allows the seller of the product to offer a better value to customers and to arrange the various mattresses in the showroom so as to promote each of the aspects of the mattress configuration and allow a user the best opportunity to select their prefer mattress configuration.

Accordingly, the materials for the various sectors and layers will depend on the choices made by the person or persons who will use the mattress. A very heavy person for example will generally prefer a mattress which does not yield as readily as one for a lighter-weight person. A pillow top cover 60 is warmer and softer than a stretch cover.

Also, the nature of the foam forming each block is of importance. Many persons prefer a springy mattress. For this a closed-cell foam is most desirable. Others prefer a slower yielding, less springy support, dependent on rate of application of weight and temperature. For these people, often an open cell foam is preferable on the top layer or zone. Another type of foam can be either open or closed celled, but whose material is inherently viscoelastic and rate sensitive.

The mattress as a unit should ordinarily tend to be more reluctant under the heavier parts of the body, namely the central sectors, and more readily responsive to the head and the legs. In most cases, the bottom layer will be stronger and less yielding, while the top layer will tend to be more accommodating. The central layer may have any suitable response, but ordinarily will provide a response intermediate between that of the top and bottom layers.

Suitable foams are well-known in the art and require no detailed description here. The objective is to provide a mattress with a top layer that is comfortable and compatible with the physical shape and condition of the user, yieldable for comfort but returning to shape when the weight is removed, supported by a less-resilient middle layer atop a suitable bottom layer that can support weight without excessive deflection.

The choice of properties of the various regions is open to experimentation with the objective of ultimately providing to the user a bed which will accommodate the user comfortably. The choice of properties for each zone and sector available from this invention will enable the manufacturer and seller of mattresses to make available to the ultimate user a wide range of comfort and accommodation.

Foams vary dramatically in physical properties as they relate to response to compressive loads. One of the determinating factors is the density of the foam. Foams with lighter density have more voids than foams of greater density. The low density foams will "feel" softer, and depending on cell size and whether the cells are open or closed, will be less or more springy.

In addition, the molecular configuration of the matrix material will in part determine the feel (firmness) of the mattress. A layer of foam with a higher degree of rigidity will be less yielding and likelier to restore itself quickly. A viscoelastic material responds not only to the applied load, but also to the rate at which the load is applied. A quickly applied load will find a reluctant response, while the same load applied slowly will experience a more gradual, but ultimately complete response.

Also, a closed cell foam will be springier, because the compressive of the foam is resisted by the need to compress the gas in the cells. In contrast an open cell foam permits flow of gas from cell to cell, through the various and many restricted passages between cells, and will thereby be a cushioned response.

Urethane and latex foams are most commonly used, with densities varying from about 1.8 pounds to 5.00 pounds per cubic foot of the usual foam material, whether open or closed cell. As described above, the firmness and response (liveliness) of the bed can be selected by choosing among forms in this range.

If desired, when the correct selection is assembled, it may be glued together to form a unitary mattress, or may be left "loose" for future change. The thickness of the layers may also be varied. Often the bottom layer will be thicker, while the upper layer may be only 1½ to 2 inches thick. The thickness of all of the layers can be varied to suit the customer's needs and preferences.

As may be appreciated from the foregoing description, in a broad sense the present invention is a method of marketing composite foam mattresses and responding to customer satisfaction concerning the feel of a composite foam mattress assembly. The mattress is configured by forming a mattress cover having an underside and sidewalls extending upward from the underside a height of six to twelve inches to define a cavity, the sidewalls having one side of a zipper assembly attached to their upper peripheral edge, forming foam sheets of differing materials having differing physical properties into blocks sized to fit within the mattress cover cavity so as to fill the cavity defined by the mattress cover utilizing one or more of the foam sheets, and forming a plurality of cover layers of differing materials all having a mating side of a zipper assembly to match with the zipper assembly of the mattress cover. The store or retail outlet may then configure several mattresses having differing arrangements of the foam sheets in the mattress cover cavity and cover layers of differing materials to demonstrate the different support and feel of the various mattress configurations to allow a consumer to select a mattress assembly configuration suited to the customers requirements at the time of purchase. The store can then effectively assemble the mattress for the customer. With this custom assembly, the store can economically extend a money back return policy in the event that any customer concerns about the comfort of a mattress assembly cannot be remedied. After the sale, the store may receive and respond to customer concerns concerning the comfort of the mattress assembly providing at least one replacement component for the mattress assembly to remedy the customer concern and decrease the incidence of mattress assembly returns. A payment on the money back return policy is effectively prevented or minimized as customer comfort issues can almost always be resolved.

With the foregoing in mind, it should be understood that this invention is not to be limited by the embodiments shown in the drawings and described in the description, which are given by way of example and not of limitation, but only in accordance with the scope of the appended claims.

What is claimed is:

1. A composite foam mattress assembly, comprising:

a foam core having two to three layers of stacked foam sheets contained within a mattress cover having an underside and sidewalls extending upward from the underside a height approximately equal to the height of the stacked foam sheets, said sidewalls having a first side of a first zipper assembly attached to an upper peripheral edge; and an overlay cover including fabric sidewalls, a fabric bottom sheet, attached at peripheral edges to said fabric sidewalls extending upward from said bottom sheet, a fabric cover attachable by a second zipper assembly to a peripheral upper edges of said fabric sidewalls, said fabric bottom sheet and said fabric sidewalls defining a foam cavity, at least one foam sheet disposed within said foam cavity, and a second side of said first zipper assembly attached to a peripheral edges of said fabric sidewalls proximate the attachment to said fabric bottom sheet, said second side of said first zipper assembly allowing said overlay cover to be attached to said mattress cover.

2. The composite foam mattress assembly of claim 1 wherein said at least one foam sheet of said overlay cover comprises a first foam sheet of latex foam and a second foam sheet of viscoelastic foam placed side by side.

3. The composite foam mattress assembly of claim 1 wherein said at least one foam sheet of said overlay cover is one to three inches thick.

4. The composite foam mattress assembly of claim 1 wherein the first zipper assembly for attaching the overlay cover to the mattress cover has an identical zipper tooth count to the second zipper assembly for attaching said fabric cover to said fabric sidewalls of said overlay cover.

5. The composite foam mattress assembly of claim 1 wherein said foam sheet of said overlay cover is a foam made from a material selected from the group consisting of latex foam, soft urethane foam, hard urethane foam and viscoelastic memory foam.

6. The composite foam mattress assembly of claim 1 wherein said fabric cover of said overlay cover is a material selected from the group consisting of: a pillow top fabric cover and a stretch fabric cover.

7. The composite foam mattress assembly of claim 1 wherein said two or three layers of stacked foam sheets of said foam core comprise:

a soft urethane foam layer;

a hard urethane foam layer; and a viscoelastic memory foam layer.

8. The composite foam mattress assembly of claim 7 wherein said viscoelastic memory foam layer is replaced with a urethane foam layer.

9. The composite foam mattress assembly of claim 7 wherein said viscoelastic memory foam layer is replaced with a latex foam layer.

10. The composite foam mattress assembly of claim 7 wherein at least one of said three stacked layers of stacked foam sheets is divided in half and one half of said layer is formed from a urethane foam sheet and the other half of said layer is formed from a viscoelastic memory foam sheet.

11. A method of configuring and adapting the feel of a composite foam mattress assembly, comprising:

forming a mattress cover having an underside and sidewalls extending upward from the underside a height of six to twelve inches to define a cavity, said sidewalls having one side of a first zipper assembly attached to their upper peripheral edge;

forming foam sheets of differing materials having differing physical properties into blocks sized to fit within said mattress cover cavity so as to fill said cavity defined by said mattress cover utilizing one or more of said foam sheets;

forming an overlay cover including fabric sidewalls, a fabric bottom sheet, attached at peripheral edges to said fabric sidewalls extending upward from said bottom sheet, a fabric cover attachable by a second zipper assembly to a peripheral upper edges of said fabric sidewalls, said fabric bottom sheet and said fabric sidewalls defining a foam cavity; at least one foam sheet disposed within said foam cavity, and a second side of said first zipper assembly attached to peripheral edges of said fabric sidewalls proximate the attachment to said fabric bottom sheet, said second side of said first zipper assembly;

configuring the support and feel of the mattress to a consumer's preference; and subsequent to the sale and use of said mattress, providing a replacement foam sheet to reconfigure the resilience and feel of the mattress.

12. A method of fabricating a mattress and responding to customer dissatisfaction concerning the feel of a composite foam mattress assembly, comprising:

forming a mattress cover having an underside and sidewalls extending upward from the underside a height of six to twelve inches to define a cavity, said sidewalls having one side of a first zipper assembly attached to their upper peripheral edge;

forming foam sheets of differing materials having differing physical properties into blocks sized to fit within said mattress cover cavity so as to fill said cavity defined by said mattress cover utilizing one or more of said foam sheets;

forming an overlay cover including fabric sidewalls, a fabric bottom sheet, attached at peripheral edges to said fabric sidewalls extending upward from said bottom sheet, a fabric cover attachable by a second zipper assembly to a peripheral upper edges of said fabric sidewalls, said fabric bottom sheet and said fabric sidewalls defining a foam cavity; at least one foam sheet disposed within said foam cavity, and a second side of said first zipper assembly attached to peripheral edges of said fabric sidewalls proximate the attachment to said fabric bottom sheet, said second side of said first zipper assembly;

configuring the support and feel of the mattress to a consumer's preference;

receiving and responding to customer complaints concerning the temperature and firmness of the mattress assembly; and subsequent to the sale and use of said mattress, providing a replacement component of the mattress assembly to remedy the customer complaint by providing a foam sheet to reconfigure the resilience and firmness of the mattress and the perceived temperature of the mattress assembly.

13. A method of marketing composite foam mattresses and responding to customer satisfaction concerning the feel of a composite foam mattress assembly, comprising:

forming a mattress cover having an underside and sidewalls extending upward from the underside a height of six to twelve inches to define a cavity, said sidewalls having one side of a first zipper assembly attached to their upper peripheral edge;

forming foam sheets of differing materials having differing physical properties into blocks sized to fit within said mattress cover cavity so as to fill said cavity defined by said mattress cover utilizing one or more of said foam sheets;

forming an overlay cover including fabric sidewalls, a fabric bottom sheet, attached at peripheral edges to said fabric sidewalls extending upward from said bottom sheet, a fabric cover attachable by a second zipper assembly to a peripheral upper edges of said fabric sidewalls, said fabric bottom sheet and said fabric sidewalls defining a foam cavity; at least one foam sheet disposed within said foam cavity, and a second side of said first zipper assembly attached to peripheral edges of said fabric sidewalls proximate the attachment to said fabric bottom sheet, said second side of said first zipper assembly;

configuring several mattresses having differing arrangements of said foam sheets in said mattress cover cavity and cover layers of differing materials to demonstrate the different support and feel of the various mattress configurations to allow a consumer to select a mattress assembly configuration suited to the customers requirements at the time of purchase;

extending a money back return policy in the event that any customer concerns about the comfort of a mattress assembly cannot be remedied;

receiving and responding to customer concerns concerning the comfort of the mattress assembly; and subsequent to the sale and use of said mattress assembly by the customer, providing at least one replacement component for the mattress assembly to remedy the customer concern and decrease the incidence of mattress assembly returns.

* * * * *